US008523545B2

(12) United States Patent
Wilbourn et al.

(10) Patent No.: US 8,523,545 B2
(45) Date of Patent: Sep. 3, 2013

(54) STATOR TO HOUSING LOCK IN A PROGRESSING CAVITY PUMP

(75) Inventors: Phillip R. Wilbourn, Claremore, OK (US); Charles C. Collie, Tulsa, OK (US); Larry V. Dalrymple, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 817 days.

(21) Appl. No.: 12/643,730

(22) Filed: Dec. 21, 2009

(65) Prior Publication Data

US 2011/0150685 A1 Jun. 23, 2011

(51) Int. Cl.

| | |
|---|---|
| ***F01C 1/02*** | (2006.01) |
| ***F01C 1/063*** | (2006.01) |
| ***F04C 5/00*** | (2006.01) |

(52) U.S. Cl.
USPC ..... 418/50; 418/48; 418/51

(58) Field of Classification Search
USPC ..... 418/50, 51, 48
See application file for complete search history.

(56) References Cited

U.S. PATENT DOCUMENTS

| | | | | |
|---|---|---|---|---|
| 1,652,468 | A * | 12/1927 | Catlin | 384/296 |
| 1,892,217 | A | 12/1932 | Moineau | |
| 2,028,407 | A | 1/1936 | Moineau | |
| 3,139,035 | A * | 6/1964 | O'Connor | 418/48 |
| 3,271,081 | A | 9/1966 | Huddleston | |
| 3,280,753 | A * | 10/1966 | Zimmer | 418/48 |
| 4,029,443 | A * | 6/1977 | Burnside et al. | 418/48 |
| 5,318,416 | A | 6/1994 | Hantschk et al. | |
| 5,435,650 | A * | 7/1995 | Emig et al. | 384/29 |
| 5,474,432 | A * | 12/1995 | Hulley et al. | 418/48 |
| 5,759,019 | A | 6/1998 | Wood et al. | |
| 5,820,354 | A | 10/1998 | Wild et al. | |
| 6,082,980 | A | 7/2000 | Papin | |
| 6,336,796 | B1 | 1/2002 | Cholet et al. | |
| 6,397,462 | B1 * | 6/2002 | Lanteigne et al. | 29/888.02 |
| 6,457,958 | B1 | 10/2002 | Dunn | |
| 6,705,402 | B2 | 3/2004 | Proctor | |
| 6,716,008 | B1 | 4/2004 | Kachlel | |
| 6,868,912 | B2 | 3/2005 | Proctor | |
| 7,131,827 | B2 | 11/2006 | Jager et al. | |
| 7,192,260 | B2 | 3/2007 | Lievestro et al. | |
| 7,201,222 | B2 | 4/2007 | Kanady et al. | |
| 7,299,873 | B2 | 11/2007 | Hartman et al. | |
| 7,314,089 | B2 | 1/2008 | Howard et al. | |
| 7,407,372 | B2 | 8/2008 | Guidry et al. | |
| 2002/0153141 | A1 | 10/2002 | Hartman et al. | |
| 2003/0003000 | A1 | 1/2003 | Shepherd et al. | |

(Continued)

FOREIGN PATENT DOCUMENTS

| | | |
|---|---|---|
| DE | 3322095 | 12/1984 |
| EP | 0844397 | 5/1998 |

(Continued)

*Primary Examiner* — Mary A Davis
(74) *Attorney, Agent, or Firm* — Steve Rosenblatt

(57) ABSTRACT

A reinforcing interface between the stator and its housing in a progressing cavity pump is created from ribs extending inwardly into the stator from the housing inner wall that can be longitudinally oriented or spirally oriented. Alternatively, the housing wall can have grooves into the inner wall that are made more bulbous further into the housing wall from the groove inlets so that when filled with stator material a long and continuous grip is obtained with either the wall groove embodiment or the internal rib embodiment.

19 Claims, 3 Drawing Sheets

(56) References Cited

U.S. PATENT DOCUMENTS

| | | | | |
|---|---|---|---|---|
| 2005/0045332 | A1 | 3/2005 | Howard et al. | |
| 2005/0169779 | A1 | 8/2005 | Bratu | |
| 2006/0131079 | A1 | 6/2006 | Bottos | |
| 2006/0182644 | A1* | 8/2006 | Delpassand et al. | 418/45 |
| 2007/0071921 | A1 | 3/2007 | Coulas | |
| 2008/0050259 | A1 | 2/2008 | Hooper | |
| 2008/0122182 | A1 | 5/2008 | Parker et al. | |
| 2008/0304992 | A1 | 12/2008 | Hooper et al. | |
| 2009/0068024 | A1 | 3/2009 | Amburgey et al. | |
| 2009/0129937 | A1 | 5/2009 | Zarowny et al. | |
| 2009/0152009 | A1 | 6/2009 | Slay et al. | |
| 2009/0169404 | A1 | 7/2009 | Sindt et al. | |

FOREIGN PATENT DOCUMENTS

| | | |
|---|---|---|
| EP | 0934464 | 12/2004 |
| EP | 1095218 | 7/2007 |
| GB | 2352008 | 1/2001 |
| GB | 2423318 | 8/2006 |
| JP | 61180512 | 8/1986 |
| WO | 9745641 | 12/1997 |
| WO | 02077459 | 10/2002 |
| WO | 03008807 | 1/2003 |
| WO | 2009031473 | 3/2009 |

* cited by examiner

STATOR TO HOUSING LOCK IN A PROGRESSING CAVITY PUMP

FIELD OF THE INVENTION

The field of the invention is progressing cavity stators and more particularly devices that enhance adherence of the stator to its housing apart from interface adhesives.

BACKGROUND OF THE INVENTION

Progressing cavity pumps (PCP) were invented in the 1930s by Moineau as seen in U.S. Pat. Nos. 1,892,217 and 2,028,407.

A progressing cavity pump has a stator and a rotor. The stator typically comprises an elastomeric liner within a housing. The stator is open at both ends and has a multi-lobe helical passage extending through it. The rotor is normally of metal and has a helical exterior formed on it. Rotating the rotor causes fluid to pump through the stator. Progressing cavity pumps are used for a variety of purposes.

As a well pump, progressing cavity pumps may be driven by a downhole electrical motor or by a string of rods extending to a motor located at the surface. With a rod driven pump, normally the stator is suspended on a string of tubing, and the drive rods are located within the tubing. When installing a rod driven progressing cavity pump, the operator first secures the stator to the string of tubing and runs the tubing into the well to a desired depth. The operator then lowers the rotor through the tubing on the string of rods and into the stator.

To operate the pump at desired capacity, the rotor must be at the desired axial spacing within the stator and the rods must be in tension. If the lower end of the rotor is spaced above a lower end of the stator during operation, then a lower portion of the stator will not be in engagement with the rotor and the pumping capacity will suffer. The operator thus needs to know when the rotor has fully entered the stator during installation. The operator can calculate how much the rods will stretch due to the hydrostatic weight of the column of well fluid in the tubing. With the anticipated stretch distance known and with the rotor at a known initial position in the stator, the operator can pull the rods and rotor upward a distance slightly greater than the anticipated stretch, so that during operation, the rotor will move back downward to the desired axial position relative to the stator.

Stators are manufactured by insertion of a core into a tubular housing and capping the ends with the core properly positioned. The inside wall of the housing can have an adhesive coating before the material for the stator is injected through one of the end caps and forced under pressure to fill the annular space between the core and the housing inner wall. The adhesive was used in the past to help the stator body adhere to the surrounding housing. Depending on the size and the particular application, the housing could be over 10 meters long and could have an inside housing wall diameter smaller than 10 centimeters.

As the industry develops, PCPs are being deployed in progressively hotter environments to the point where the commercially available adhesives reach their temperature service limit in the order of about 150° C. In an effort to allows stators to operate effectively at higher temperatures structures have been proposed to be supported from the housing inside wall and extend inwardly such that when the stator was created within the housing a core and injected rubber around it, the end result would be a better bond to the housing inside wall than just using adhesive by itself. Along those lines U.S. Pat. No. 7,407,372 suggests a ring structure with openings that allow the rubber to pass through during manufacturing and positioned in the stator housing with L-shaped rings 18 that are welded to the stator inside wall as shown in FIGS. 2 and 3 of that patent. FIGS. 4 and 5 show another embodiment of such a ring with openings and external grooves 52 that lead to openings 54 so that the rubber can hopefully envelope the ring structure 50. The grooves are stated to be longitudinal or spiral and FIG. 5 further shows L-shaped indents at opposed ends into the ring 50 from the inside that are stated to help seal the rubber to the ring structure 50.

There are several issues with this design. In a long housing it is expensive and difficult to secure the intermediate standoff supports 18 to the housing inner wall. The more substantial the tube for structural rigidity the less rubber can be used as the stator. On the other hand if the tube is too flimsy so as to maximize the rubber content it will be structurally weaker to the point that during stator manufacturing with the core in the housing and the ring held by supports, the delivery of rubber under very high pressures to fill all the void space between the housing inner wall and the core will result in flexing of the tube to the point where it will touch the core. When the core is then removed portions of the tube extend out of the stator and damage the rotor.

Other references relating to PCP stator construction are: U.S. Pat. Nos. 3,280,753; 5,318,416; 7,131,827; JP 61180512; DE 3322095; US 2009/0152009; 2009/0169404; 2002/0153141; 2009/0129937; U.S. Pat. Nos. 7,299,873; 7,201,222; 6,868,912 and 6,705,402.

What is needed and provided by the present invention is a simple way to enhance grip of the stator to its housing that is structurally sound against torsional stresses and offers in some embodiments the ability to stiffen the stator. This is accomplished with modifications to a tubular housing for the stator that can have elongated ribs extending inwardly from the housing inner wall disposed longitudinally or in a spiral array. The spiral array can have ribs spiraling all in one direction or with one or more ribs spiraling in the opposite direction forming an overlapping pattern of ribs. These ribs are formed as an integral part of the housing either by extrusion, machining, or welding such that they cannot move with respect to the housing during injection of the stator rubber or due to torsional stresses during operation. The reverse of inwardly extending ribs can also be used in the form of wall grooves in the stator housing interior wall that preferably have a bulbous region further into the wall from a narrower inlet so that a grip is created when the internal groove structure is filled with injected rubber to form the stator. These and other aspects of the present invention will become more readily apparent to those skilled in the art from a review of the description of the preferred embodiment and the associated drawings while recognizing that the full scope of the invention is defined by the literal and equivalent scope of the appended claims.

SUMMARY OF THE INVENTION

A reinforcing interface between the stator and its housing in a progressing cavity pump is created with ribs extending inwardly into the stator from the housing inner wall that can be longitudinally oriented or spirally oriented. Alternatively, the housing wall can be formed to have grooves into the inner wall that are made more bulbous further into the housing wall from the groove inlets so that when filled with stator material a long and continuous grip is obtained with either the wall groove embodiment or the internal rib embodiment.

DETAILED DESCRIPTION OF THE PREFERRED EMBODIMENT

Figure 1:
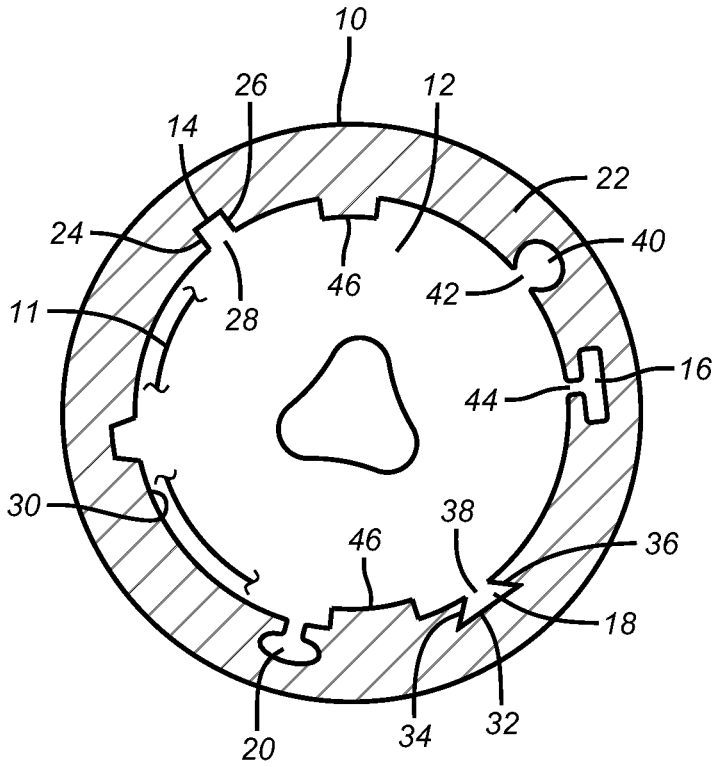
FIG. 1 is a section view of a stator housing showing the elongated groove disposed in the housing wall and the form that has a narrow entrance leading to a bulbous or a larger region.

FIG. 1 shows a section through a stator housing 10 showing the stator 12 developed in the housing 10 using known injection techniques with a core placed into the housing 10. An assortment of grooves 14, 16, 18 and 20 are shown disposed within the wall 22. They can be configured in several ways. Groove 14 is square or rectangular with parallel sides 24 and 26 so that the entrance 28 is as wide as the groove 14 for the entire depth. Not shown but may be present in groove 14 as well as any other groove shown in FIG. 1 is an adhesive bonding material that helps adhere the stator 12 to the walls of groove 14. The number of grooves such as 14 can vary keeping in mind the structural need for the housing 10 as well as the capabilities of an extrusion process that can be used to form the grooved housing 10 as a seamless tube cut to the desired length for a particular application. In the preferred embodiment and for reason of cost of manufacturing among other reasons, the groove 14 is continuous. It can be completely straight along its length while oriented to parallel to the longitudinal axis of the housing 10 or it can be in a helical or spiral format with one or more grooves 14 circumferentially equally spaced or unequally spaced at any given cross-section. One or more of the spiral groves may spiral in the opposite direction of the other groves. While square or rectangular groove profiles such as used in groove 14 resist torsional stresses from rotation of the schematically illustrated rotor 11 within the stator 12 thus reducing such forces acting on the adhesive bond between the stator 12 and the inner wall 30 of housing 10, the other illustrated configurations add resistance to mechanical separation in a radially inward direction toward the center of the housing 10 that is not found in the configuration of groove 14.

Groove 18 for example has a dovetail shape with a flat groove bottom 32 and a pair of converging side walls 34 and 36 in the direction from the bottom 32 to the center of the housing 10. This shape leads to a groove inlet 38 that is considerably smaller in width than bottom 32. Still the inlet 38 cannot be overly minimized because while doing so increases resistance to pullout of the stator 12 in a radial direction, the decreased width will reduce the resistance of the stator 12 at the inlet 38 to shear force from torsional reaction forces imparted from rotation of the rotor (not shown) and the fluid moving through the stator 12.

Groove 20 is similarly configured to groove 18 except rather than an angled dovetail shape it is more bulbous and somewhat elliptical while groove 40 shows a more circular bulbous configuration with a smaller entrance 42. Groove 16 shows generically a rectangular or quadrilateral shape within the groove again with a narrower entrance 44.

Figure 2:
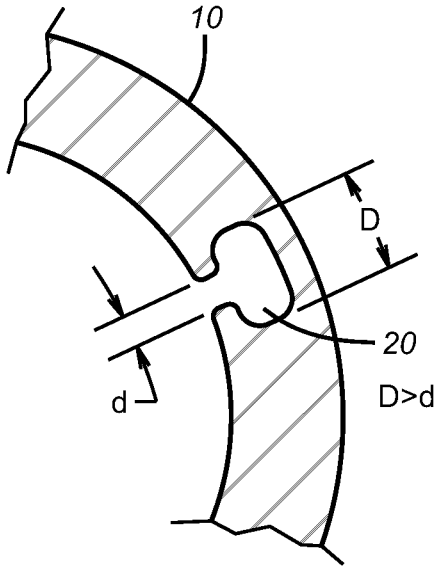
FIG. 2 of a single groove such as shown in FIG. 1.

FIG. 2 shows in section a single groove 20 that the interior width D is larger than the entrance width d. In the preferred embodiment the ratio of D/d is greater than 2.

Figure 3:
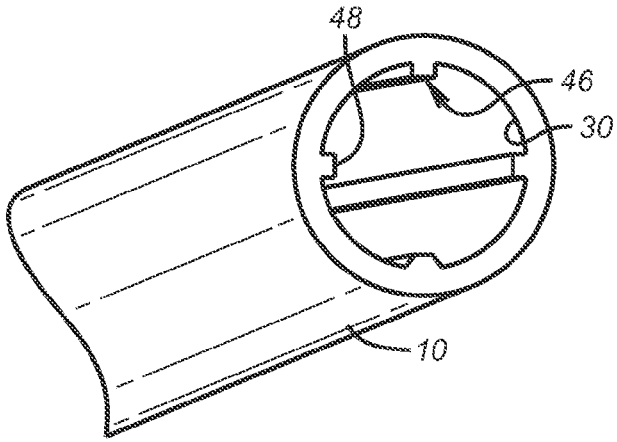
FIG. 3 is an alternative embodiment using ribs shown in an end view of a stator housing.
Figure 4:
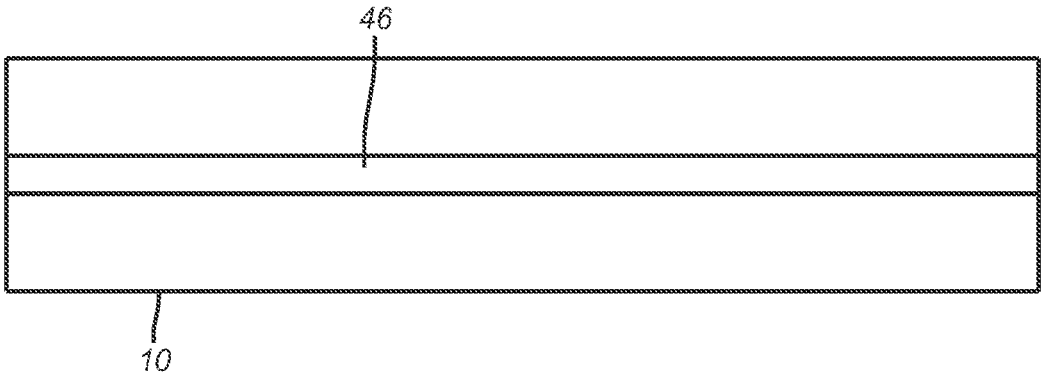
FIG. 4 is an internal view of a longitudinally oriented rib within a stator housing.
Figure 5:
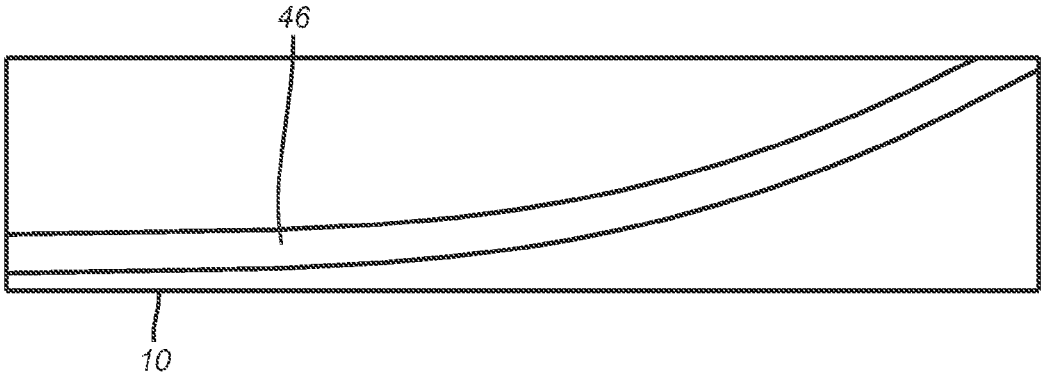
FIG. 5 is the rib of FIG. 4 showing a spiral orientation.

FIG. 3 shows an alternative embodiment of ridges 46 that extend radially inwardly from interior wall 30 and preferably extend for the length of the housing 10 as shown in the alternative interior views of FIGS. 4 and 5. The ridges 46 can be straight and oriented parallel to the longitudinal axis of the housing 10 or spiraling as shown in FIG. 5. The spacing can be equal or unequal and the ridges can be continuous or discontinuous. The number of ridges will depend on space limitations of the inside diameter of the housing 10. While shown as a quadrilateral shape in FIG. 3 as being a cost effective design to produce by extrusion when making a seamless housing 10 other shapes are contemplated. Because of the radial extension from the wall 30 it is preferable to avoid minimizing the transition width of each ridge at the wall intersection at 30 so that the result of a flimsy cantilevered structure that flexes too much is avoided. However, use of a partial circular or rounded shape or a trapezoidal or elliptical or other bulbous shape that has its largest dimension at the interface of wall 30 is one suitable approach to preserving structural rigidity against torsional moments created when the rotor (not shown) is rotating in the stator (not shown in FIG. 3 so that the ridges can be seen going into housing 10). Alternatively the dimension at the wall 30 interface can be somewhat smaller than the top 48 of any particular ridge while still retaining enough rigidity against torsional stresses.

While the shape of the grooves or ridges are preferably created as the housing 10 is extruded, ridges 46 can be attached after the housing tube is fabricated and welded or otherwise affixed to the interior wall 30. Alternatively, the grooves can be made separate from the extrusion process into a seamless tube wall using other techniques such as wire EDM for example.

Grooves and ridges the same or different shapes can also be combined in a single housing. The groove or ridge can extend continuously or discontinuously for the substantial length of the housing 10 with substantially meaning at least for half the length of the housing 10. When extending discontinuously the segments need not be axially or circumferentially aligned but can be offset.

Figure 6:
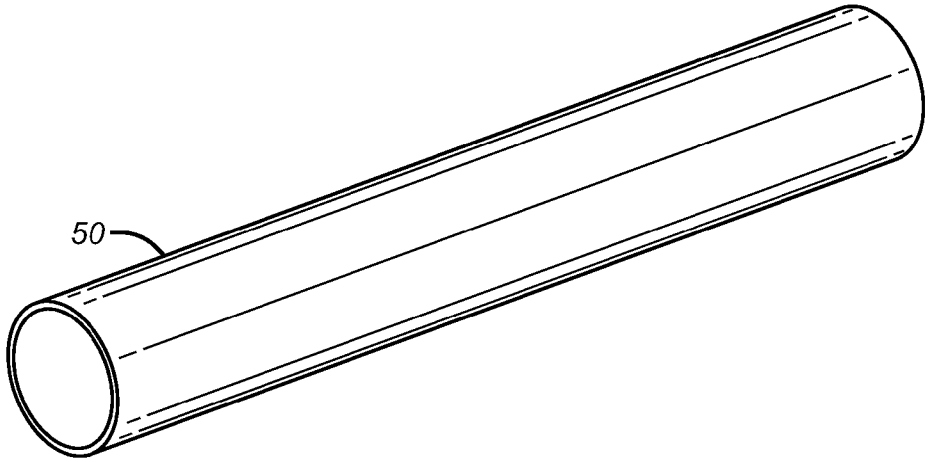
FIG. 6 is a stator tube before insertion of the stator retention device of FIG. 7.
Figure 7:
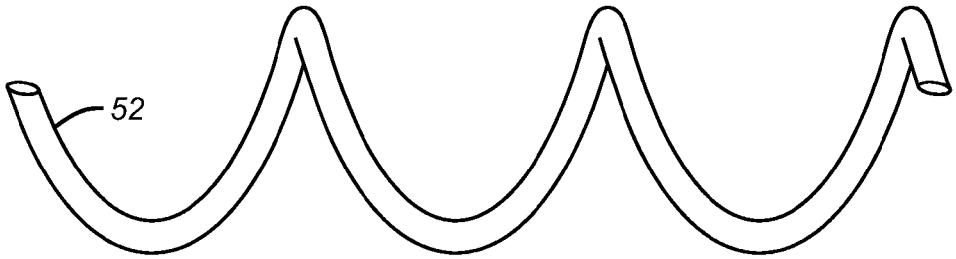
FIG. 7 is a coiled spring brought to a reduced diameter for insertion into the stator housing shown in FIG. 6.
Figure 8:
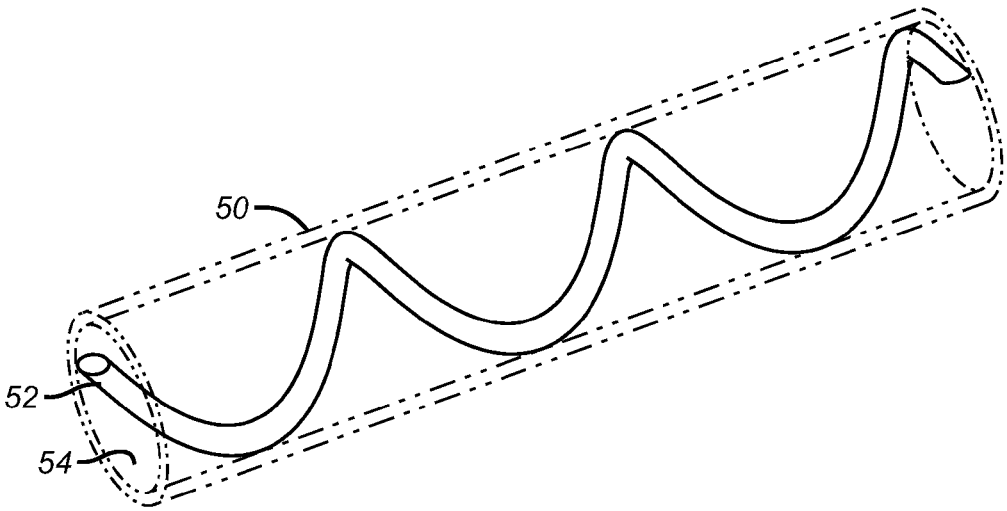
FIG. 8 is the spring uncoiled in the stator housing so that it is fixed by radially outward spring force against the inner wall of the stator housing to retain the stator to the housing after the stator is formed in the housing.

FIGS. 6-8 show a stator housing 50 and a coiled spring 52 rotated to a reduced diameter so that it can be inserted into the housing 50 and set loose to use the released potential energy to snap against the inner wall 54 of the housing 50 for position fixation as a ridge inside stator housing 50. The core (not shown) is then inserted in the housing 50 and the annular space in between is injected with the material that will form the stator 12 which will be anchored in place by the radial spring force of the coils in spring 52 pushing against the wall 54 for fixation above and beyond any bonding forces of the stator 12 or any adhesive applied to the wall 54 before forming the stator with injected material. Spring or springs 52 can be used with grooves 14 or ridges 46 or by themselves. Ridges can be combined with grooves or springs. All permutations of the three elements in groups of three two or one are envisioned When used with ridges 46 such ridges can have gaps to allow the spring to sit against the housing inner wall so that the ridge breaks help to fixate the spring or springs 52. The spring 52 can also be considered as a ridge.

The above description is illustrative of the preferred embodiment and many modifications may be made by those skilled in the art without departing from the invention whose scope is to be determined from the literal and equivalent scope of the claims below.

We claim:

1. A progressing cavity pump, comprising:

a housing;

a stator in direct contact with said housing and extending for the substantial length of said housing;

a rotor rotatably mounted in said stator;

at least one groove at an interior wall of said housing, said housing directly contacting said stator along the substantial length of said housing, said at least one groove extending along the substantial length of said housing;

said stator extending into said at least one groove to resist relative movement between said stator and said housing;

said at least one groove is wider within the wall of said housing than at an entrance located at said interior surface of said housing wall;

said housing defining an interior wall;

said at least one groove extends in a first direction into said housing from said interior wall;

said housing further comprising at least one ridge extending from said interior wall in an opposite direction from said groove.

2. The pump of claim 1, wherein:

said at least one ridge extending in a straight line or a spiral.

3. The pump of claim 2, wherein:

said at least one ridge having a shape in a section therethrough of at least one of a quadrilateral, a trapezoid an ellipse or a circle.

4. The pump of claim 1, wherein:

said at least one ridge is continuous.

5. The pump of claim 4, wherein:

said at least one ridge extends the entire length of said stator in said housing.

6. The pump of claim 1, wherein:

said at least one ridge is wider at a base at the wall of said housing than at a peak located inwardly of said housing wall.

7. The pump of claim 1, wherein:

said at least one ridge in the wall of said housing comprising a plurality of ridges in the wall of said housing.

8. The pump of claim 7, wherein:

said plurality of ridges are circumferentially equally or unequally spaced.

9. The pump of claim 7, wherein:

said plurality of ridges extend in a straight line or a spiral.

10. The pump of claim 9, wherein:

said plurality of ridges are parallel, converging or intersecting.

11. The pump of claim 7, wherein:

said plurality of ridges are continuous.

12. The pump of claim 11, wherein:

said plurality of ridges extend the entire length of said stator in said housing.

13. The pump of claim 7, wherein:

said plurality of ridges are wider at a base at the wall of said housing than at a peak located inwardly of said housing wall.

14. The pump of claim 13, wherein:

said plurality of ridges have a shape in a section therethrough of at least one of a quadrilateral, a trapezoid an ellipse or a circle.

15. The pump of claim 1, wherein:

said at least one ridge is integral with said housing or a separate structure secured to it.

16. The pump of claim 1, wherein:

said at least one ridge is a separate structure from said housing.

17. A progressing cavity pump, comprising:

a housing;

a stator supported in said housing;

a rotor rotatably mounted in said stator;

at least one ridge extending from the wall of said housing facing said stator, said at least one ridge extending along the length of said housing;

said stator extending into said at least one ridge to resist relative movement between said stator and said housing;

said at least one ridge is a separate structure from said housing;

said at least one ridge is retained to said housing using potential energy stored in said ridge.

18. A progressing cavity pump, comprising:

a housing;

a stator supported in said housing;

a rotor rotatably mounted in said stator;

at least one ridge extending from the wall of said housing facing said stator, said at least one ridge extending along the length of said housing;

said stator extending into said at least one ridge to resist relative movement between said stator and said housing;

said at least one ridge is a separate structure from said housing;

said at least one ridge is retained to said housing using potential energy stored in said ridge;

said at least one ridge comprises at least one coiled spring.

19. A progressing cavity pump, comprising:

a housing;

a stator supported in said housing;

a rotor rotatably mounted in said stator;

at least one ridge extending from the wall of said housing facing said stator, said ridge extending along the length of said housing;

said stator extending into said ridge to resist relative movement between said stator and said housing;

said at least one ridge in the wall of said housing comprising a plurality of ridges in the wall of said housing;

said plurality of ridges extend in a spiral;

said plurality of ridges are parallel, converging or intersecting;

said plurality of ridges comprise at least one coiled spring.

* * * * *